US008979602B2

(12) United States Patent
Cappe et al.

(10) Patent No.: US 8,979,602 B2
(45) Date of Patent: Mar. 17, 2015

(54) ELECTRICAL MALE TERMINAL

(75) Inventors: Patrice Cappe, Faverolles (FR); Pascal Guillet, Luisant (FR); Francois Cormier, Senantes (FR); Arnaud Duquesne, Epernon (FR)

(73) Assignee: Delphi International Operations Luxembourg, S.A.R.L., Luxembourg (LU)

( * ) Notice: Subject to any disclaimer, the term of this patent is extended or adjusted under 35 U.S.C. 154(b) by 184 days.

(21) Appl. No.: 13/817,832

(22) PCT Filed: Aug. 5, 2011

(86) PCT No.: PCT/IB2011/002077

§ 371 (c)(1),
(2), (4) Date: Mar. 27, 2013

(87) PCT Pub. No.: WO2012/023038

PCT Pub. Date: Feb. 23, 2012

(65) Prior Publication Data

US 2013/0295798 A1 Nov. 7, 2013

(30) Foreign Application Priority Data

Aug. 20, 2010 (WO) ..... IB2010/002447

(51) Int. Cl.

| | |
|---|---|
| ***H01R 13/02*** | (2006.01) |
| ***H01R 13/04*** | (2006.01) |
| ***H01R 43/16*** | (2006.01) |
| ***H01R 43/26*** | (2006.01) |

(52) U.S. Cl.

CPC ..... *H01R 13/04* (2013.01); *H01R 43/16* (2013.01); *H01R 43/26* (2013.01)

USPC ..... 439/884

(58) Field of Classification Search

CPC .... H01R 13/04; H01R 13/055; H01R 13/193; H01R 4/185; H01R 43/20

USPC ..... 439/884, 886

See application file for complete search history.

(56) References Cited

U.S. PATENT DOCUMENTS

| | | | | |
|---|---|---|---|---|
| 5,681,192 | A * | 10/1997 | Kobayashi et al. | 439/884 |
| 5,795,197 | A * | 8/1998 | Tsuji et al. | 439/884 |
| 5,941,722 | A * | 8/1999 | Chen | 439/291 |
| 5,989,080 | A | 11/1999 | Tsuji et al. | |
| 6,077,131 | A | 6/2000 | Fukuda et al. | |
| 6,217,379 | B1 * | 4/2001 | D'Hulster et al. | 439/752.5 |
| 6,375,521 | B2 * | 4/2002 | Tachi et al. | 439/884 |

(Continued)

FOREIGN PATENT DOCUMENTS

| | | |
|---|---|---|
| WO | 9913533 | 3/1999 |

OTHER PUBLICATIONS

International Search Report dated Feb. 3, 2012.

*Primary Examiner* — Abdullah Riyami
*Assistant Examiner* — Vladimir Imas
(74) *Attorney, Agent, or Firm* — Robert J. Myers

(57) ABSTRACT

An electrical male terminal formed from a metal plate comprising a mating portion having contact surfaces adapted to electrically contact a female terminal. The mating portion comprises a first and second seamless strip electrically contacting the first and second female contact surfaces. The male terminal has a seam comprising a mating portion seam, within the mating portion, which is parallel to the longitudinal axis, and located on one of the side portions which are perpendicular to the contact surfaces of the mating portion.

13 Claims, 4 Drawing Sheets

(56) References Cited

U.S. PATENT DOCUMENTS

| | | | | |
|---|---|---|---|---|
| 6,572,417 | B2 * | 6/2003 | Katsuma | 439/752.5 |
| 6,659,813 | B2 * | 12/2003 | Sai | 439/884 |
| 6,666,734 | B2 * | 12/2003 | Fukatsu | 439/884 |
| 6,752,669 | B2 * | 6/2004 | Murakami et al. | 439/884 |
| 6,786,781 | B2 * | 9/2004 | Sai et al. | 439/884 |
| 6,790,106 | B2 * | 9/2004 | Ito et al. | 439/884 |
| 7,044,809 | B2 * | 5/2006 | Kuroda et al. | 439/752.5 |
| 7,422,494 | B2 * | 9/2008 | Fry et al. | 439/891 |
| 7,867,014 | B2 * | 1/2011 | Kuwayama | 439/452 |
| 2003/0060091 | A1 | 3/2003 | Fukatsu | |
| 2004/0224576 | A1 | 11/2004 | Murakami et al. | |

* cited by examiner

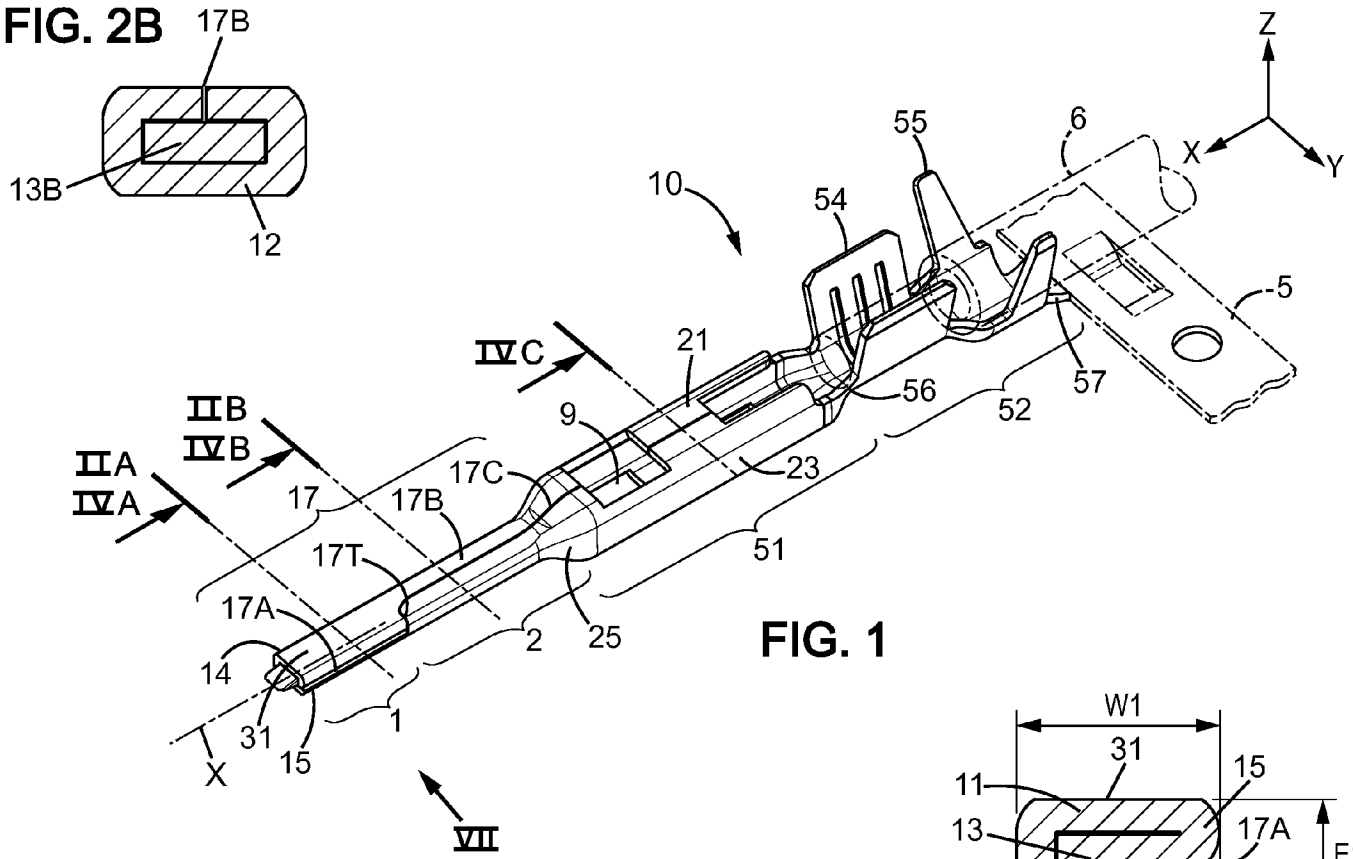
FIG. 1
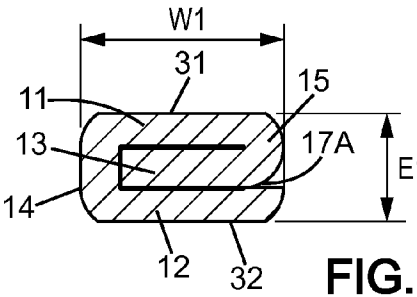
FIG. 2A
FIG. 2B

ELECTRICAL MALE TERMINAL

CROSS-REFERENCE TO RELATED APPLICATIONS

This application is a national stage application under 35 U.S.C. §371 of PCT Application Number PCT/IB2011/002077 having an international filing date of Aug. 5, 2011, which designated the United States, which PCT application claimed the benefit of PCT Application Number PCT/IB2010/002447, filed Aug. 20, 2010, the entire disclosure of each of which are hereby incorporated herein by reference.

FIELD OF THE INVENTION

The invention relates to electrical male terminals and methods of manufacturing such electrical male terminals.

BACKGROUND OF THE INVENTION

An electrical male connector comprises usually an insulator housing accommodating one or more assemblies of a male terminal mating adapted to mate with a complementary electrical female terminal.

For automotive applications in particular, connectors are submitted to vibrations, sometimes amplified by vibration resonances with the electrical cables linked to such connectors. It is of paramount importance to maintain a high quality of the electrical contact between terminal surfaces belonging to the female terminal and terminal surfaces belonging to the male terminal during the whole life of the vehicle.

For such terminals, it is also a requirement to reduce the size of such male/female terminal assemblies without reducing the electrical connection performances.

Usually, for automotive applications, an electrical male terminal comprises a wire connecting portion adapted to be crimped or soldered or attached by any adapted means to an electrical wire. Such a male terminal usually also comprise a positioning portion adapted to locate properly and lock the electrical male terminal into a surrounding housing. Further, such a male terminal comprises a mating portion adapted to electrically contact a corresponding mating female terminal.

Such electrical male terminal may be obtained from a metal sheet which is deformed to obtain the desired form and targeted dimensions.

A goal of the invention is to provide an electrical male terminal improving the current capability, while complying with the geometric requirements of the positioning portion.

BRIEF SUMMARY OF THE INVENTION

According to a preferred embodiment, the invention provides an electrical male terminal which is designed to be inserted in a housing. It comprises a positioning portion with locking means adapted to interact with the housing.

It is formed from a single metal plate. It extends substantially along a longitudinal axis. This terminal comprises a positioning portion and a mating portion.

The mating portion is defined as the portion of the male terminal which will be in electrical contact during the mating process of a male and female terminal.

The mating portion has two substantially parallel contact surfaces adapted to be in electrical contact with respectively two surfaces of the female terminal during this mating process.

The mating portion has a mating portion seam between two folded portions of the metal plate which is not located on the contact surfaces.

Such a feature allows improving the current capability, while complying with the geometric requirements of the positioning portion. Indeed, due to the folding process, a joint, sometimes also called a "seam", creates a groove or another kind of surface irregularity between two regions or portions of the folded metal sheet. Such seam may create bad contacts that are detrimental to the electrical connexion over time. The invention removes the seam from the contact surface while keeping the possibility to meet the geometric requirements of the positioning portion.

According to another aspect of the invention, the invention is directed to a method of manufacturing such a electrical male terminals.

Further, according to another aspect of the invention, the invention is directed to an assembly along a metal strip of several electrical male terminals as above defined.

In some other embodiments, one might also use one or more of the features as defined in dependent claims.

BRIEF DESCRIPTION OF THE SEVERAL VIEWS OF THE DRAWING

Other characteristics and advantages of the invention will readily appear from the following description of some of its embodiments, provided as a non-limitative example, and of the accompanying drawings.

On the drawings:

FIG. 1 is a perspective view of an electrical male terminal according to an embodiment the invention, FIGS. 2A and 2B show cross sections of the terminal of FIG. 1, with respect to lines IIA and IIB of FIG. 1.

DETAILED DESCRIPTION OF THE INVENTION

Figure 3:
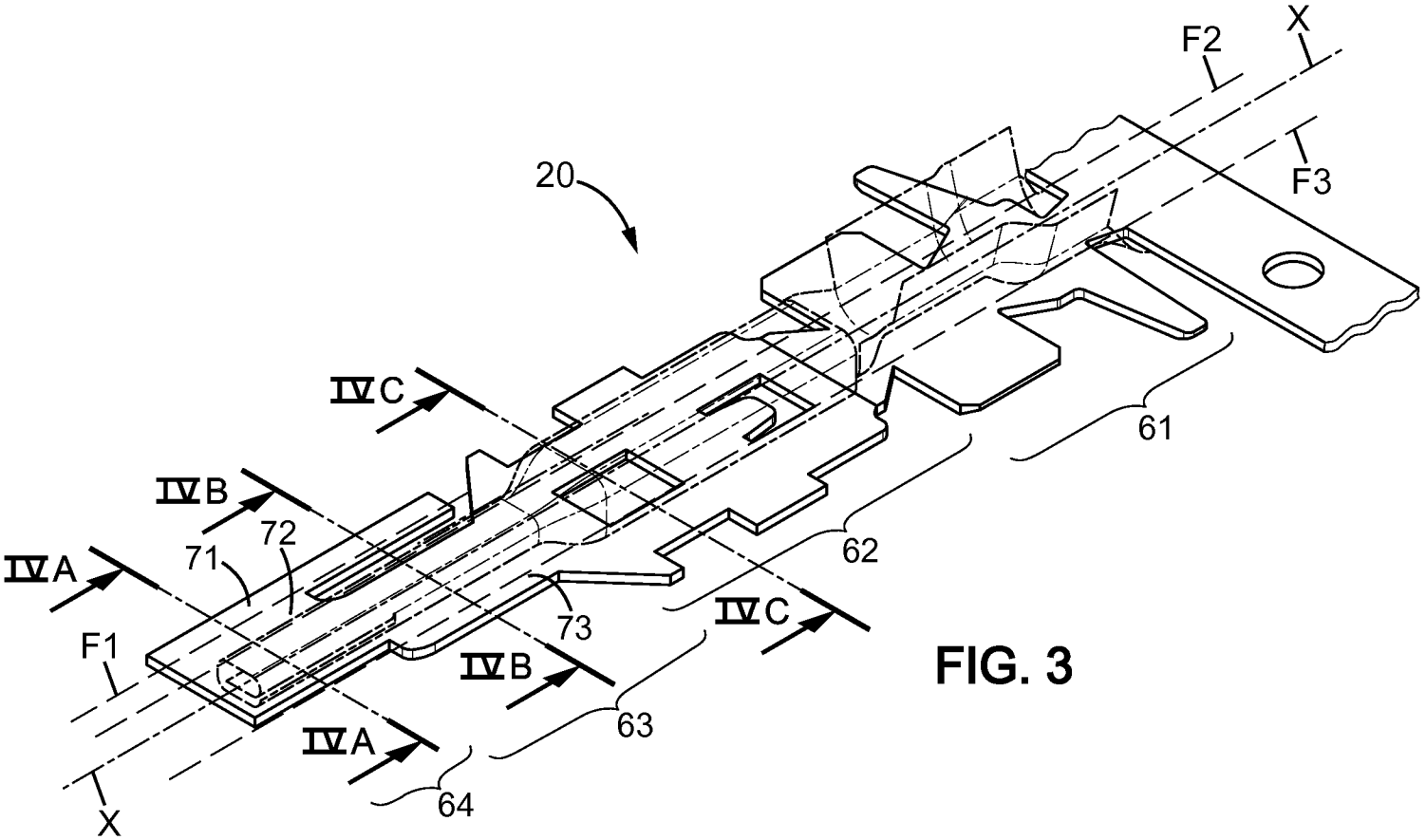
FIG. 3 is a perspective view of a unitary stamped metal plate adapted to form the terminal of FIG. 1, FIG. 4A-4C are diagrams illustrating the method of manufacturing the terminal of FIG. 1, according to different sections respectively with respect to lines IVA, IVB, IVC of FIGS. 1 and 3.

FIG. 1 shows an electrical male terminal 10 extending generally along a longitudinal axis (X). This terminal comprises a wire crimping portion 52 adapted to receive an electrical wire 6 (shown in phantom line) which can be crimped within the wire crimping portion 52 as well known in the art thus not described in details here. The wire crimping portion 52 exhibits first legs 54 adapted to be crimped around the metal core of the wire 6 and second legs 55 adapted to be crimped around the insulation layer of the wire 6.

The terminal also comprises a positioning portion 51, extending from the wire crimping portion 52 along the longitudinal axis (X). The positioning portion 51 is linked to the wire crimping portion 52 by an attachment junction 56. The wire crimping portion 52 has a cross-section perpendicular to the longitudinal axis (X) which has a generally rectangular shape with a top face 21, a bottom face 22, parallel and opposed to the top face 21, and side faces 23,24 (visible on FIG. 4C). The side faces 23, 24 are perpendicular to and adjacent to the top and bottom faces (21, 22). The positioning portion 51 further comprises locking means, for instance a locking window 9 open in the top face 21. The positioning portion 51 is adapted to position and lock the electrical male terminal 10 properly in a surrounding housing (not shown).

Figure 7:
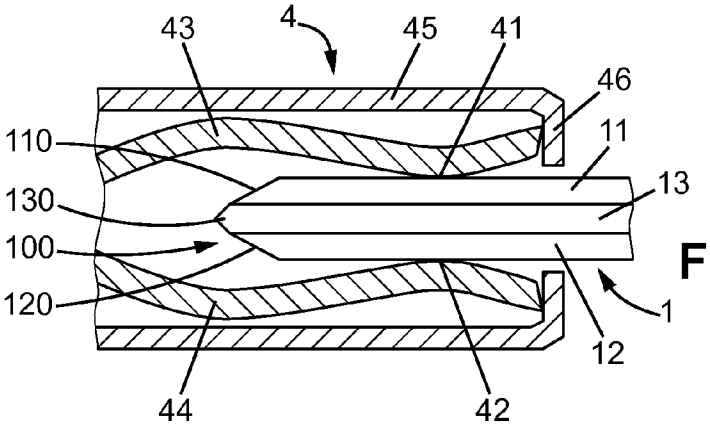
FIG. 7 is a partial cross-section of an assembly of the male terminal of FIG. 1 and a corresponding female terminal.

The terminal further comprises a mating portion 1, adapted to electrically mate and connect with a corresponding female terminal 4 (shown partially in FIG. 7). The mating portion 1 extends along the longitudinal axis (X) and comprises a top contact surface 31 parallel to the top face 21 of the positioning portion 51, a bottom contact surface 32 opposed to the top surface 31, and side portions (14, 15), adjacent to the top and bottom surfaces (31, 32). The mating portion 1 has a cross section, perpendicular to the longitudinal axis (X), defining a male terminal width W1 and a male terminal thickness E1 (cf. FIG. 2A).

The terminal further comprises a transition portion 2, extending between the positioning portion 51 and the mating portion 1 along the longitudinal axis (X). The transition portion 2 has a first end adjacent to a respective end of the positioning portion 51 with a tapered section 25. The tapered section 25 corresponds to a matching cross section the surface of which decreases from the first end towards a portion of the transition portion 2 having a cross-section substantially equal to the cross-section of the mating portion 1.

Referring now to FIG. 1, FIG. 2A, FIG. 2B and FIG. 7, the mating portion 1 comprises a first seamless strip 11 and a second seamless strip 12. Both of the first and second seamless strips 11, 12 have a width W1 corresponding to the mating portion width W1. They form surfaces which are respectively adapted to bear on and to contact a first and second female terminal surfaces 41, 42 of the female terminal 4. The second seamless strip 12 is opposed to the first seamless strip 11. Consequently, the mating portion 1 is interposed between first and second parallel female terminal surfaces 41, 42.

In the present embodiment, the mating portion 1 further comprises a third metal strip 13 interposed between the first and second seamless strips (11, 12). The width of the third metal strip 13 is smaller than the width of the first seamless strip W1 and it corresponds to W1 minus the thickness of the first seamless strip 11.

In this embodiment, the first, second and third seamless strips 11, 12, 13 are substantially flat, and have a substantially constant and identical thickness (about E1/3 in the illustrated example).

In this embodiment the mating portion 1 is made of a metal sheet 20 (copper, aluminum, metal alloy, etc.). This metal sheet 20 is folded and exhibits a seam or joint (17, 17A, 17B, 17C) after folding. This seam 17 comprises a mating portion seam 17A, located in the mating portion 1, which is parallel to the longitudinal axis (X), and located on one of the side portions (14, 15).

The seam 17 also comprises a positioning portion seam 17C located on the top face 21 of the positioning portion 51.

The seam 17 further comprises transition portion seam 17B extending from the mating portion seam 17A to the a positioning portion seam 17C.

In this embodiment, the transition portion seam 17B comprises a transverse portion 17T which is perpendicular to the longitudinal axis (X), the transverse portion 17T having two ends, a first end adjacent to the mating portion seam 17A, and a second end adjacent to a quarter of circle, the quarter of circle joining the transverse portion 17T to the rest of the following transition portion seam 17B which is located at the median longitudinal line of the top surface 31, as also clearly illustrated on FIG. 2B.

As illustrated in particular in FIG. 2B, a portion 13B of the third metal strip 13 extends in the transition portion 2 up to the tapered section 25, under the two adjacent halves 18, 19 located on top on the third metal strip 13

As illustrated in particular in FIG. 2A, the second seamless strip 12 is linked to the first seamless strip 11 by a first curved side portion 14 having a C-shaped cross section, and the third seamless strip 13 is linked to the second seamless strip 12 by a second curved side portion 15 having a C-shaped cross section.

Therefore, the mating portion 1 and the transition portion 2, excepted the tapered section 25, comprise a three-layer configuration with the three seamless strips 11, 12, 13 which are superimposed. The three-layer configuration of the mating portion 1 provides it with a good mechanical strength and in particular a good robustness against flexion and torsion forces. This further provides the male terminal 10 with a good electrical current capability.

The surfaces 31, 32 are free from any seam or joint which is beneficial to improve the terminal surface with the corresponding contact surfaces of the female terminal 4.

Instead of a locking window 9 as mentioned above the positioning portion 51 may have any other locking means, for example a locking leg protruding from a top face 21, a side face 23, 24, or a bottom face 22. Such a locking means is adapted to engage a complementary locking means in the surrounding housing (not shown) to retain the male terminal 10 in an appropriate position.

The positioning portion seam 17C intersects the locking window 9. Advantageously, it corresponds to the median longitudinal line of the top face 21. Therefore, the positioning portion 51 has a symmetry plane parallel to a vertical XZ plane running through the longitudinal axis (X).

Figure 6:
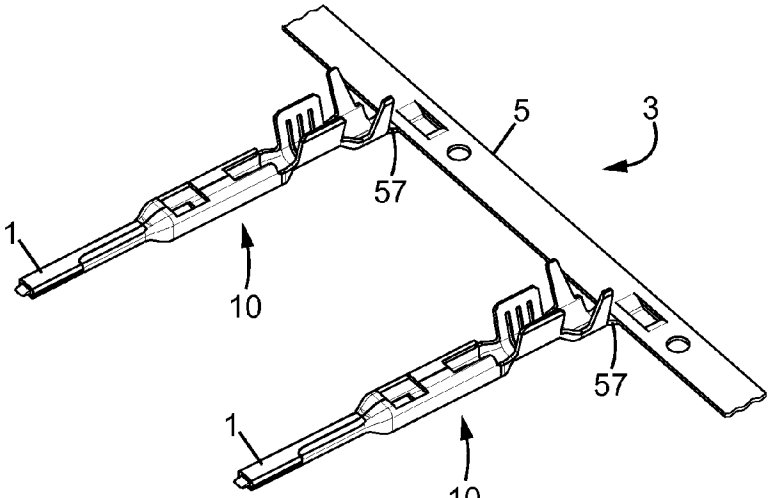
FIG. 6 shows an assembly of several terminals as the one of FIG. 1.

According to another aspect of the invention, as illustrated on FIG. 6, it is provided a product 3 comprising a linking strip 5 extending along the transverse direction (Y) and a plurality of male terminals 10 as defined above, each one of which being mechanically attached to the linking strip 5.

According to another aspect of the invention, a method of manufacturing is provided in order to produce a male terminal 10 as described above.

Usually the male terminals 10 are manufactured by batches, i.e. a large plurality of electrical male terminals 10 being attached to the already mentioned linking strip 5.

Starting with a bare metal sheet having the desired thickness, a stamping operation is used to output a plurality of flat stamped metal sheets 20 as the one illustrated in FIG. 3. The plurality of identical stamped metal sheets 20 are attached along a linking strip 5 at predetermined positions.

The forming process comprises a succession of forming operations, which will be explained hereafter with the help of FIGS. 3, 4A, 4B and 4C.

The unitary stamped metal sheet 20 has a flat surface and comprises a first portion 61 adapted to form the wire crimping portion 52, a second portion 62 adapted to form the positioning portion 51, a third portion 63 adapted to form the transition portion 2, and a fourth portion 64 adapted to form the mating portion 1.

From another point of view, the unitary stamped metal sheet 20 comprises a first member 71 extending along the longitudinal axis (X), adapted to form the third metal strip 13, a second member 72 also extending along the longitudinal axis (X), and adapted to form the second seamless strip 12 and one half 18 of the top surface of the transition portion 2 and one side 24 of the positioning portion 51, a third member 73 also extending along the longitudinal axis (X), and adapted to form the second half 19 of the top surface of the transition portion 2 and the other side 23 of the positioning portion 51, and a fourth member 74 adapted to form, in the mating portion 1, the second seamless strip 12 and, in positioning portion 51, the bottom face 22.

Figure 4C:
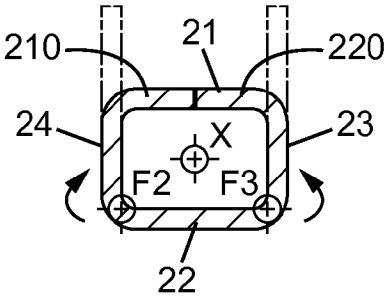
Figure 4B:
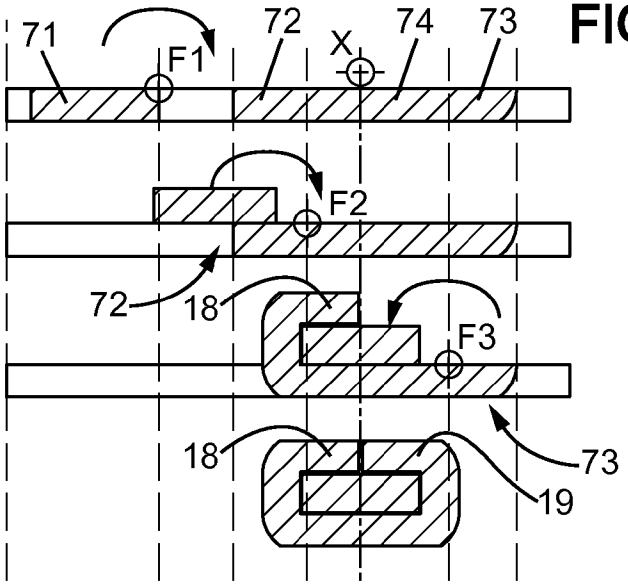
Figure 4A:
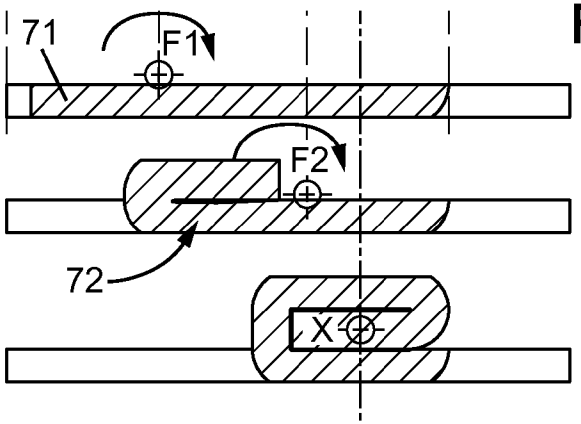

The forming process comprises for example as illustrated on FIGS. 4A-4C, at least the following operations:

(a) folding the first member 71 substantially with a 180-degree angle around a first folding axis (F1) parallel to the longitudinal axis, the first member 71 forming the third metal strip 13 (see the top sketch of FIG. 4A), (b) folding the second member 72, in the mating portion 1, with a substantially 180-degree angle around a second folding axis (F2) parallel to the longitudinal axis, the second member 72 carrying the first member 71; this result in a three-layer configuration in the mating portion 1 as illustrated in the middle sketch of FIG. 4A, (c) folding the second member 72, in the positioning portion 51, with a 90-degree angle around the second folding axis (F2), (d) folding the third member 73, in the positioning portion 51, with a 90-degree angle around a third folding axis (F3) parallel to the longitudinal axis as illustrated in the bottom sketch of FIG. 4B.

Further forming step(s) are necessary to obtain the desired form, in particular for the positioning portion 51. As illustrated in FIG. 4C, additional folding steps allow folding both halves 210, 220 toward the horizontal plane XY, to result in forming the top face 21 of the positioning portion 51.

When all forming steps are performed, it is provided, as illustrated in FIG. 6, a product 3 comprising a linking strip 5 and a plurality of electrical male terminals 10 as described above.

Further, one or more male terminals 10 can be detached from the product 3 by cutting or breaking the attachment bridge 57 (cf. FIGS. 1 and 6). Further, a resulting individual male terminal 10 can be crimped on a wire 6 as mentioned above.

The seam 17 may be located elsewhere within the top face 21, for example on a side portion. The seam 17 may also comprise different curved portions. The locking window 9 may be located elsewhere, for example in the side faces 23, 24, and of course there may be several locking windows.

FIG. 7 shows an assembly of electrical terminals comprising a male terminal 10 as described above, and a corresponding female terminal 4 (only partially shown in FIG. 7). The female terminal 4 comprises a first and a second elastic members 43, 44 having respectively a first and a second female terminal surfaces 41, 42 adapted to bear respectively on the top and bottom surfaces 31, 32 of the mating portion 1.

The tip 100 of the mating portion 1 comprises a bevel shape comprising a first bevel section 110 belonging to the first seamless strip 11, a second bevel section 120 belonging to the second seamless strip 12 and a third bevel section 130 belonging to the third seamless strip 13.

The absence of seam 17 on the surfaces 31,32,41,42 improves the quality of the electrical contact, and suppresses the risk of mechanical damage during mating or unmating, thereby ensuring an increased lifetime of the terminals.

Figure 5:
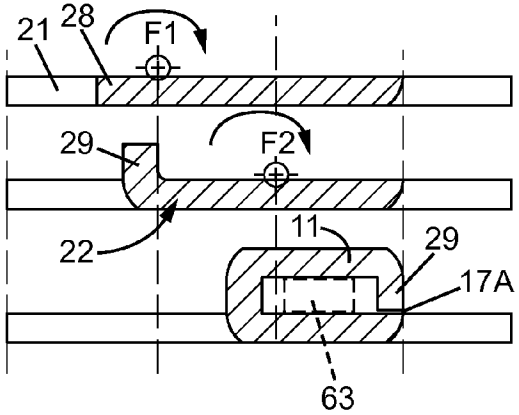
FIG. 5 is a diagram similar to FIG. 4A, illustrating a variant of the embodiment of FIG. 1.

In a variant of the above embodiment, illustrated in FIG. 5, the first member 28 is slightly narrower than the first member 71 of the preferred embodiment, while all the other aspects are similar to the preferred embodiment. Therefore, the third metal strip 13 is reduced to a folded side rib 29 that defines the thickness E1 of the mating portion 1.

Furthermore, an additional spacer 63 can be inserted between first and second seamless strips 11, 12, as shown in FIG. 5. This additional spacer 63 can be a tooling extension that will not remain the terminal, or can be an additional part remaining in the male terminal 10. In this variant, it should be noted that the thickness of the seamless strips 11, 12 can be different from E1/3: the thickness of the additional spacer 63 and or the side rib 29 can be greater or smaller than E1/3. The thickness of the metal sheet 20 can be for example reduced, regardless of the target thickness E1 for the mating portion 1.

The invention claimed is:

1. An electrical male terminal designed to be inserted in a housing and formed by folding a single metal plate, said male terminal extending substantially along a longitudinal axis and comprising:

a positioning portion, comprising a locking means adapted to interact with the housing, and a mating portion having two substantially parallel contact surfaces adapted to be in electrical contact with respectively two surfaces of a female terminal when the mating portion is inserted/mated with the female terminal, wherein the mating portion has a mating portion seam between two folded portions of the folded metal plate which is not located on the two substantially parallel contact surfaces and wherein the mating portion comprises a first seamless strip having a first strip width, and adapted to electrically contact a first female terminal surface, and a second seamless strip having a second strip width corresponding to the male terminal width, opposed to the first seamless strip and adapted to electrical contact the second female terminal surface, and a third metal strip interposed between the first seamless strip and the second seamless strip.

2. The terminal according to claim 1, wherein the mating portion seam is located on a side portion adjacent to the two substantially parallel contact surfaces.

3. The terminal according to claim 2, wherein the positioning portion has a positioning portion seam between the two folded portions of the metal plate which is located on a face which is substantially perpendicular to the side portion comprising the mating portion seam.

4. The terminal according to claim 2, comprising a transition portion having a transition portion seam between the two folded portions of the metal plate which is located on a face which is substantially perpendicular to the side portion comprising the mating portion seam.

5. The terminal according to claim 4, wherein the transition portion seam extends between the mating portion and the positioning portion, over a terminal portion which has a substantially constant cross-section, itself substantially equal to a cross section of the mating portion.

6. The terminal according to claim 5, wherein the transition portion seam comprises a transverse portion which is perpendicular to the longitudinal axis.

7. The terminal according to claim 2, comprising a tapered section corresponding to a matching cross-section of a surface which decreases from the positioning portion towards a portion of a transition portion having a cross-section substantially equal to the cross-section of the mating portion, the tapered section comprising a seam between the two folded portions of the metal plate which is located on a face which is substantially perpendicular to the side portion comprising the mating portion seam.

8. The terminal according to claim 1, wherein first, second and third metal strips are substantially flat, exhibits a substantially constant thickness and have a substantially identical thickness.

9. The terminal according to claim 1, wherein a portion of the third metal strip extends into a transition portion.

10. A product comprising:

a linking strip; and the terminal according to claim 1, the terminal mechanically attached to the linking strip.

11. An assembly of electrical terminals comprising:

the terminal according claim 1; and a corresponding mating female terminal having first and second female terminal surfaces adapted to electrically contact respectively first and second contact surfaces of the mating portion.

12. An electrical male terminal formed from a single metal plate comprising:

a wire connecting portion;

a positioning portion; and a mating portion adapted to come in electrical contact with a corresponding mating female terminal by interposition between first and second parallel female terminal surfaces belonging to the mating female terminal, wherein the mating portion extends along a longitudinal axis, comprises a top surface, a bottom surface and side portions, and has a cross section perpendicular to the longitudinal axis defining a male terminal width and a male terminal thickness, wherein the mating portion comprises a first seamless strip having a first strip width corresponding to the mating portion width, and adapted to bear on the first female terminal surface, and a second seamless strip having a second strip width corresponding to the mating portion width, opposed to the first seamless strip and adapted to bear on the second female terminal surface, wherein the electrical male terminal has a seam, wherein the seam comprises a mating portion seam, within the mating portion, which is parallel to the longitudinal axis, and located on one of the side portions, wherein the positioning portion comprises a bottom face and a top face which are parallel to the first seamless strip, wherein the seam comprises a positioning portion seam located on the top face of the positioning portion, wherein the seam comprises a transition portion seam extending from the mating portion seam to the positioning portion seam, wherein the positioning portion comprises a locking window or a locking leg, wherein the positioning portion seam of the seam intersects the locking window.

13. A method of manufacturing an electrical male terminal comprising the steps of:

providing a unitary metal plate extending along a longitudinal axis and with at least one terminal pattern adapted to be deformed to form an electrical male terminal comprising, a positioning portion, comprising a locking means adapted to interact with a housing, a mating portion having two substantially parallel contact surfaces adapted to be in electrical contact with respectively two surfaces of a female terminal when the mating portion is inserted/mated with the female terminal, wherein the mating portion has a mating portion seam between two folded portions of the folded metal plate which is not located on the two substantially parallel contact surfaces and wherein the mating portion comprises a first seamless strip having a first strip width, and adapted to electrically contact a first female terminal surface, and a second seamless strip having a second strip width corresponding to the male terminal width, opposed to the first seamless strip and adapted to electrical contact the second female terminal surface, and a third metal strip interposed between the first seamless strip and the second seamless strip; and folding the metal plate so as to have a seam between two folded portions of the folded metal plate which is not located on the contact surfaces.

* * * * *